United States Patent [19]

Pichon

[11] 4,111,809

[45] Sep. 5, 1978

[54] DEVICE FOR THE REMOVAL OF A LIQUID LAYER ON WATER

[75] Inventor: Jacques Pichon, Eybens, France

[73] Assignee: Societe Generale de Constructions Electriques et Mecaniques Alsthom, Paris, France

[21] Appl. No.: 633,372

[22] Filed: Nov. 19, 1975

Related U.S. Application Data

[63] Continuation-in-part of Ser. No. 527,707, Nov. 27, 1974, abandoned.

[30] Foreign Application Priority Data

Dec. 11, 1973 [FR] France ..... 73 44189

[51] Int. Cl.[2] ..... E02B 15/04

[52] U.S. Cl. ..... 210/242 R; 210/DIG. 25; 210/512 R

[58] Field of Search ..... 209/211; 210/84, 104, 210/114, 115, 242 S, 512, DIG. 21, 512 R

[56] References Cited

U.S. PATENT DOCUMENTS

| | | | |
|---|---|---|---|
| 3,615,017 | 10/1971 | Valdespino | 210/242 |
| 3,656,619 | 4/1972 | Ryan et al. | 210/512 X |
| 3,662,892 | 5/1972 | Sorenson | 210/242 |
| 3,701,429 | 10/1972 | Schell | 210/242 S |
| 3,709,366 | 1/1973 | Pruitt | 210/242 |
| 3,722,689 | 3/1973 | Markel et al. | 210/242 S |
| 3,741,391 | 6/1973 | Donsbach | 210/242 |
| 3,753,492 | 8/1973 | Aiello et al. | 210/242 |
| 3,753,496 | 8/1973 | Boyd | 210/242 S |
| 3,753,497 | 8/1973 | Hoffman | 210/242 S |
| 3,784,009 | 1/1974 | Maciula | 210/512 R |
| 3,789,988 | 2/1974 | Valibouse et al. | 210/242 S |
| 3,794,175 | 2/1974 | Stewart | 210/242 S |
| 3,800,951 | 4/1974 | Mourlan et al. | 210/242 S |
| 3,810,546 | 5/1974 | Oxenham | 210/242 |
| 3,853,767 | 12/1974 | Mohn | 210/242 |
| 3,853,768 | 1/1973 | Bagmulo | 210/242 |
| 3,909,417 | 9/1975 | Rafael | 210/242 S |

FOREIGN PATENT DOCUMENTS

| | | | |
|---|---|---|---|
| 2,051,577 | 4/1972 | Fed. Rep. of Germany | 210/242 |
| 2,433,660 | 2/1975 | Fed. Rep. of Germany | 210/242 |
| 2,308,048 | 8/1974 | Fed. Rep. of Germany | 210/242 |
| 330,234 | 3/1972 | U.S.S.R. | 210/242 |

*Primary Examiner*—Theodore A. Granger
*Attorney, Agent, or Firm*—John J. Hart

[57] ABSTRACT

The floating apparatus comprises a cyclone carrying a normally submerged dam forming with the body of the cyclone a water compartment containing the cyclone inlet orifice. The sill of the dam is situated below but close to the free surface of the body of water from which the pollutant is to be removed and such sill is formed to create a continuous flow of water and pollutant into the compartment to form therein a level of the mixture lower than that of the free surface of the body of water. The dam has a height enabling the level of the water in the compartment to be maintained constantly higher than the inlet orifice of the cyclone. Suction means are connected to the lower outlet for filling the cyclone up to its ceiling with the liquid mixture from the compartment for producing in such mixture a cyclonic rotation capable of separating the water and pollutant by centrifugation and concentrating the pollutant in an axial central zone of the cyclone, and for removing the water freed from the pollutant through the lower outlet of the cyclone. Another suction means removes the separated concentrated pollutant through the ceiling of the cyclone. Means are provided to adjust the inlet flow of the cyclone so as to maintain the level of the mixture in the compartment at a constant height.

6 Claims, 5 Drawing Figures

DEVICE FOR THE REMOVAL OF A LIQUID LAYER ON WATER

This application is a continuation-in-part of application Ser. No. 527,707, filed Nov. 27, 1974 now abandoned.

The present invention has for its object an improvement to U.S. Pat. No. 3,789,988 of Feb. 5, 1974, that patent relating to apparatus for removing surface layers of polluting products on water.

The apparatus described in that patent is composed of a device pulled or pushed by a boat or, even, stationary in a current, for collecting in a suitable thickness, some of the water and the polluting substance floating on its surface, under the unique effect of the relative speed of movement. The relative speed is used to direct the water and the pollutant by tangential introduction, into one or several chambers of a cyclone, filling the latter with the water and polluting liquid up to ceiling(s) thereof and causing in the cyclone a cyclonic rotation having the effect of forming a swirling zone creating a concentration of polluting liquid in its central axial zone from which the pollutant is removed by a tube placed in the axis and leaving the ceiling of the cyclone. The centrifugated water, rid of the polluting substance, is removed through a lower outlet of the cyclone.

As indicated, the operation of the aforesaid apparatus is based on the use of the relative speed of the advancing movement of the device in relation to the expanse of water to be purified and operates all the better if that speed is high. In the several embodiments described, the apparatus is provided, at its front, with a scoop drawing off, in a suitable thickness, some of the water and the polluting substance and operating as a sunk spillway.

The present invention has as for its principal object the provision of apparatus capable of removing layers of products floating on a heavier liquid, without requiring any relative advancing movement thereof in relation to the expanse of water to be purified, that is, a device which can operate in a stationary condition in an expanse of water which has substantially no current such as a harbor, lake, basin, etc., as well as rivers.

It has been found that in the operation of apparatus such as disclosed in the aforesaid U.S. Pat. No. 3,789,988 which is dependent on the utilization of relative speed, the effectiveness of such operation is dependent on the accumulation of the pollutant beyond the scoop above the cyclone inlet until it reaches a thickness sufficient to enable such accumulation to come in through the said inlet. When it was attempted to operate such an apparatus in a stationary condition in water having no current, by causing the necessary flow with the use of a suction pump placed at the lower outlet of the cyclone while keeping the front scoop sunk, to feed the cyclone with water and with surface polluting products, only water was sucked up into the cyclone; the polluting products, being lighter, remaining at the surface and not accumulating because of the immobility of the apparatus.

Tests carried out by the applicant have shown that in order to provide an operational stationary cyclone apparatus for the recovery of liquid pollutants on the surface of restricted water areas, it is necessary to effect the feeding of the cyclone from a submerged dam having a sill capable of producing, at all moments, a continuous flow in a torrential regime with the forming, downstream, before the cyclone inlet, of a constant independent level lower than that of the surface of the water in the restricted area.

The maintenance of that torrential flow at a predetermined level whatever the operating conditions of the device in the expanse of water may be (waves, swirl currents, etc.) can be accomplished by an adjustment of the flow at the cyclone inlet. This adjustment of the flow at the cyclone inlet may be effected either by controlling the discharge rate of the pump at the upper or lower orifice of the cyclone by means of a device for detecting the level of the water downstream from the sill which has been previously fixed at a determined value, or by providing one or several water inlets having a suitable cross-section in a wall of the device below the level of the surface of the water. When the apparatus is provided with such inlets, the flow of water which is set up by these extra inlets automatically compensates the differences in flow rates at the cyclone inlet, to maintain the sill in the position previously fixed, for the flow rate at these inlets is, at all times, a function of the difference in pressure between the inside and the outside of the device, that latter pressure being directly related to the level of the water downstream from the sill.

The aforesaid level detecting device and water inlets are also of advantage when in the use of the apparatus there are encountered waves having troughs of such depth that they completely uncover the sill as in such a situation they prevent air from being sucked into the cyclone, which would unprime it and considerably disturb its operation.

In accordance with the present invention, there is provided a submerged dam having a sill situated close to the free surface of the expanse of water on which the pollutant is floating and capable of creating a continuous flow in a torrential regime with the forming downstream before a cyclone inlet, an independent level lower than that of such free surface of the water expanse. The downstream level formed by the torrential flow may be that of a hydraulic jump, or one caused by the control of a given discharge rate of the cyclone. The flow in the cyclone is produced by a suction means arranged at its lower outlet, the action of that means having the effect of filling the said cyclone up to the ceiling and of producing a cyclonic rotation of the water and of the polluting liquid and their separation by centrifugation. The polluting material is concentrated in a central axial zone from which it is removed through the ceiling of the cyclone by suction applied through a tube placed in the axis of such zone. The water which has been rid of the polluting material, is removed by suction means placed at the lower outlet of the cyclone. Cyclone inlet flow adjustment means are provided to stabilize the downstream liquid level caused by the torrential flow and to prevent air from being drawn into the cyclone when there occurs a wave having a deep enough trough to uncover the sill.

Preferred embodiments of the invention are disclosed by way of example in the following description and in the accompanying drawings, in which FIG. 1 is a perspective schematic view of the essential portion of an operative apparatus embodying the invention;

Figure 1:
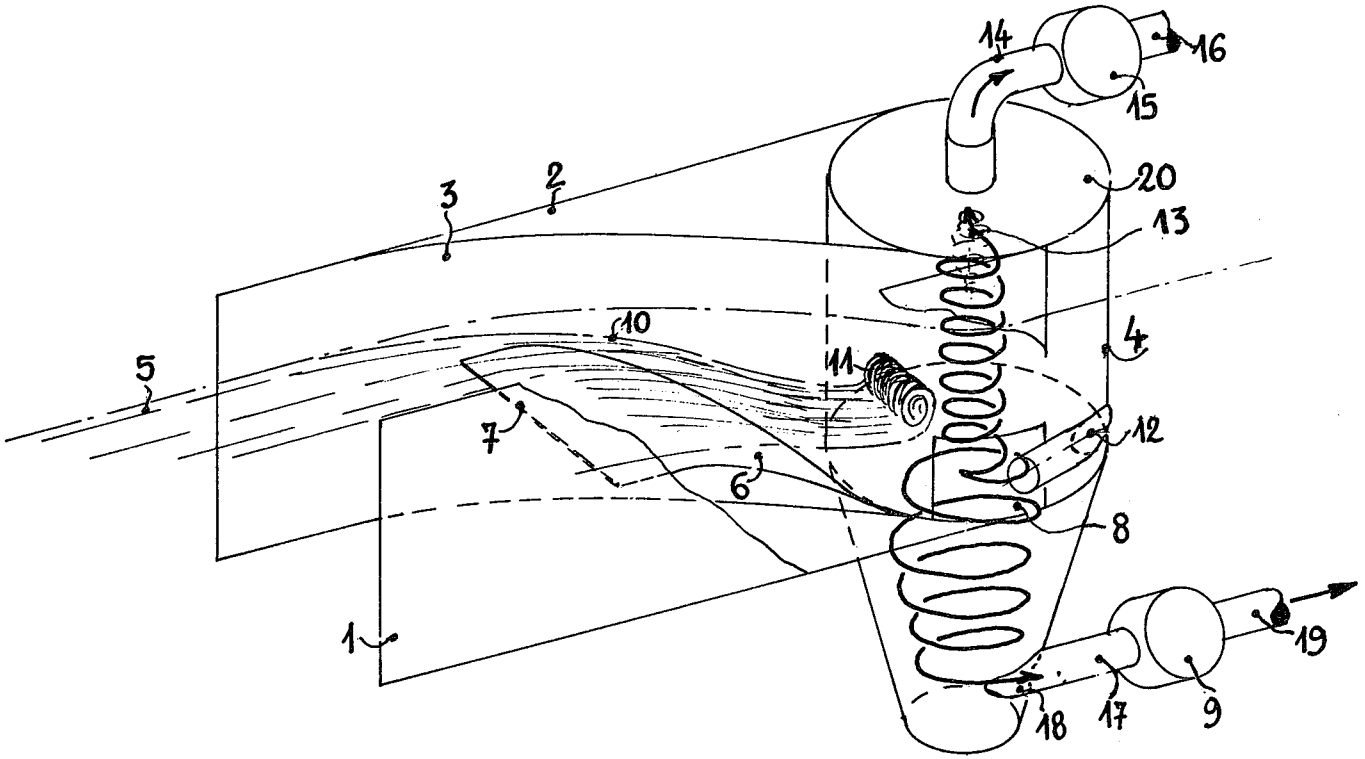
Figure 5:
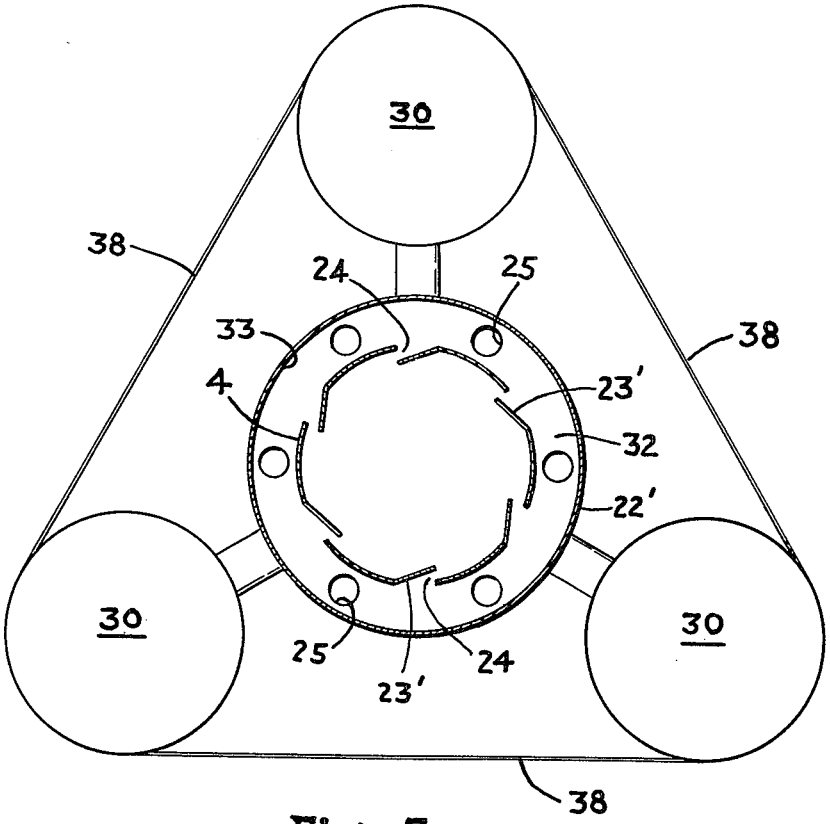
FIG. 5 is a horizontal, sectional schematic view of a modification of FIG. 4.

The apparatus of this invention forms part of a unit which floats in the water area from which the liquid pollutants are to be removed and may be supported in the body of water by floats in the manner of the floats 30 shown in FIG. 5 of the drawings to maintain a dam carried by such apparatus normally submerged in the body of water. As shown in FIG. 1 of the drawings, the normally submerged dam embodied in such apparatus is mounted on a cyclone 4 and may comprise a plane vertical wall 1 and a vertical wall 2 having a curved inside face 3 forming with the wall 1 a converging passage in front of the cyclone 4. The wall 1 provides a plane vertical inner guide surface which is tangential to the casing wall of the cyclone 4 at the following vertical edge of the inlet orifice 8 of the cyclone. The inside face 3 of the wall 2 at its inner end coincides with the advanced vertical edge of the inlet orifice 8. The apparatus is maintained by the floats at a given immersion level on the expanse of water to be cleaned. As indicated, the water has on its surface a layer of polluting liquid 5, for example oil.

Located in the converging passage defined by the walls 1 and 2 is a sill 6 having an outer free end 7 which is situated slightly below the polluting layer and having an inner end terminating at the lower horizontal edge of the tangential inlet orifice 8 of the cyclone 4. The sill 6 forms with the inside face of the wall 1, and the inside face 3 of the wall 2 a submerged dam which is mounted on the cyclone so that with the external vertical surface portion of the cyclone above the inlet orifice 8 of such cyclone there is provided a water compartment or pocket for receiving the torrential flow created by the sill. The level of the mixture of water and pollutant created by such torrential flow is always above the upper edge of the orifice 8, but below the free surface of the body of water from which the pollutant and water were taken. The level of the mixture in said compartment is controlled by a suction pump 9 which also causes the liquid mixture entering into the cyclone 4 through the tangential inlet slot 8 situated below the free surface of the water body to fill the cyclone up to the ceiling. The liquid inside the body of the cyclone is rotated about the vertical axis of the cyclone at a velocity sufficiently high to effect the separation of the polluting product from the water by the suction pump 9 which is provided on a pipe 17 connected to the lower outlet 18 of the cyclone.

It is known that gravity has a substantial effect upon the state of flow of water. Changes in water channel can create waves that exert a weight or gravity force. When the initial flow of the water is of a low velocity, the inertial forces created by a momentary change in the local depth of the water in the channel, become dominant and cause the water to assume a high velocity which is usually described as rapid, shooting and torrential (supercritical). When the rapid change in the depth of flow is from a low stage to a high stage, the result is usually an abrupt rise of water surface known as the hydraulic jump. The extent of this rise of water surface depends on the depth of change. If the change in depth is small, the jump will be small and the water surface will not rise obviously and abruptly. On the other hand, when the change in depth is great, there is caused a sudden obvious turbulant rise in the channel. If there is no channel bottom following a sudden change in depth, the hydraulic drop created by a momentary change in the local depth of the wter will be in the nature of a free overfall. In such a situation the flow will also be torrential (supercritical) due to the action of the inertial forces, but the jump will disappear.

The aforesaid effects of gravity upon the state of flow of liquids, is utilized in the present invention to create at the entrance inlet of the cyclone a continuous supply of water and pollutant in a torrential (supercritical) condition. Necessarily the level of such torrential mixture will be lower than that of the surface of the water and, as has been previously indicated, may be controlled to maintain it at a given level.

The embodiment shown in FIG. 1 of the drawings, has been designed to cause a continuous flow in torrential regime to take place on the cyclone feed sill 6, with the forming of a jump 11 below the free level of the surface of water with a position stabilized at a constant level above the inlet orifice 8. The stabilizing of the jump is accomplished by an extra tangential water inlet 12 in direct communication with the expanse of water and whose flow rate, which is a function of the height of the external liquid level above the jump 11, adapts itself as a function of the flow entering through the orifice 8 so as to compensate automatically the fluctuations in the level of the jump 11.

The water inlet 12 performs another important function. In the use of apparatus such as shown in FIG. 1 not provided with the extra water inlet 12, when waves having deep troughs are encountered the entrance 7 of the sill could become uncovered momentarily and no liquid would flow along the sill 6 to enter the cyclone, which would then suck in air and would become unprimed, thus stopping its operation. However, by providing the extra water inlet 12 at the base of the cyclone this disadvantage is overcome. The fact that the inlet 12 is directly in communication with the expanse of water below the level of the surface of the water, ensures that it will always automatically feed the cyclone with water even if the sill entrance is uncovered by high waves.

The turbulent zone created inside the cyclone under the effect of the suction of the pump 9, by its cyclonic rotation, causes an axial central concentration 13 of polluting liquid to be formed. The polluting liquid, completely rid of its water, is sucked up by means of a pump 15 and a central tube 14 through the ceiling 20 of the cyclone and directed, through the pipe 16, into a storage tank.

The water gathered towards the bottom of the cyclone is sucked out by the pump 9 and discharged through the pipe 19 into the expanse of water.

Figure 4:
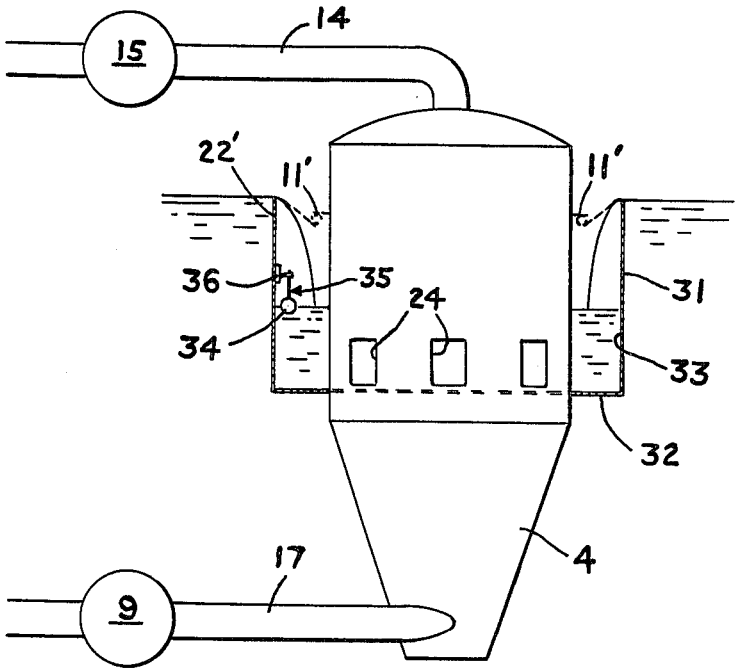
FIG. 4 is an elevational schematic view of still another embodiment of the invention.

The automatic adjustment of the flow rate of the pollutant mixture into the cyclone can also be effected, by using instead of the water inlet 12, a known device of the type shown in FIG. 4 of the drawings for detecting the level of the jump 11, and arranged to control the discharge of one of the two pumps 9 or 15 so as to stabilize that jump at the required constant level.

Figure 2:
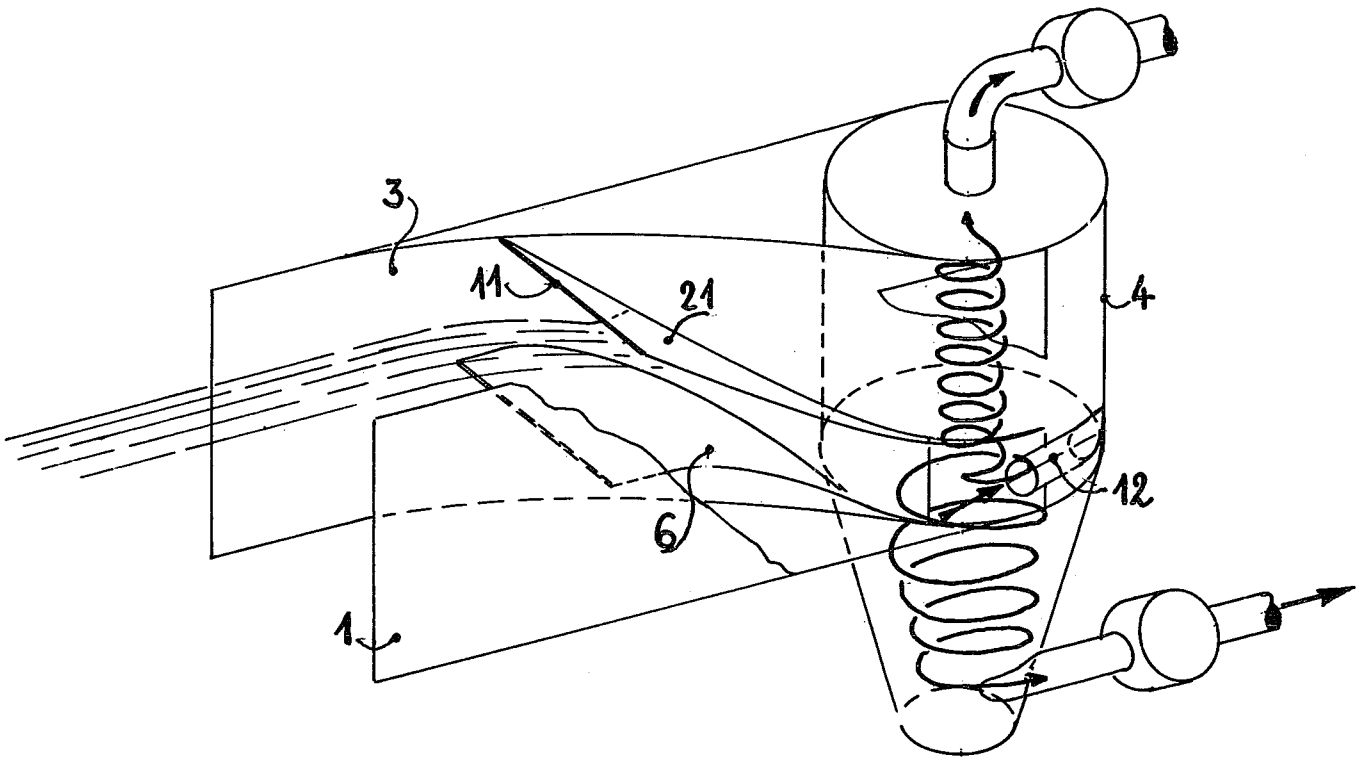
FIG. 2 is a view similar to FIG. 1 and showing a variant of the apparatus depicted in FIG. 1.

As illustrated in FIG. 2 of the drawings, a guide vane 21 having a suitable shape could be installed above the sill 6, so as to improve the flow of liquid into the cyclone. The jump 11 is then formed on coming into contact with the guide vane 21.

The arrangements in FIGS. 1 and 2 are used, to great advantage, for effecting the purifying in narrow spaces, for example in ports, between the hulls of boats or other obstacles.

Figure 3:
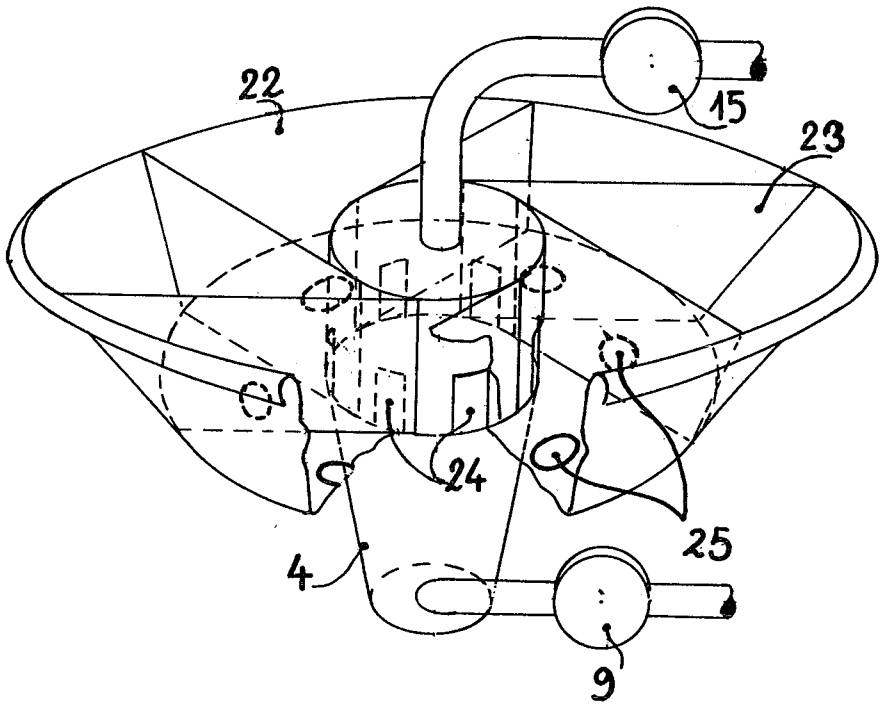
FIG. 3 is a perspective schematic view of another embodiment of the essential portion of an apparatus embodying the invention.

Instead of constructing the submerged dam with walls 1 and 3 and a sill 6 in the manner shown in FIGS. 1 and 2, the submerged dam may be constituted of a substantially circular receptacle enclosing the cyclone 4, as shown in FIG. 3 of the drawings. The dam is pan-shaped with a circular sill 22 and the cyclone projects upwardly through an opening in the bottom wall of the dam. The portion of the cyclone above the bottom wall of the dam is provided with a plurality of circumferentially spaced inlet orifices 24. The inclined circular side wall of the dam is connected to the portion of the cyclone enclosed thereby, by vertical guide vanes 23 which are tangent to the body of the cyclone 4 and direct the liquid mixture towards the inlet orifices 24 of the cyclone. As in the apparatus of FIGS. 1 and 2, the apparatus of FIG. 3 is maintained at a predetermined immersion level by floats, such as the floats 30 of FIG. 5. The construction shown in FIG. 3 enables a circular sweeping in zones free from obstacles.

As a variant, the extra water inlets intended for automatically regularizing the rate of flow into the cyclone may be constituted of orifices 25 formed in the bottom wall of the dam.

In difficult operating conditions in stretches of choppy water where, more particularly, the waves have deep troughs which could momentarily uncover the tangential inlet of the cyclone and let air into it, there being hence a danger of its being partly or completely unprimed, the device could be fitted with the devices which are disclosed in the aforesaid U.S. Pat. No. 3,789,988 of Feb. 5, 1974 with a view to overcoming that disadvantage.

Instead of forming the submerged dam with an outwardly inclined sidewall as in the embodiment shown in FIG. 3 of the drawings, the dam may be formed, as shown in FIG. 4 of the drawings, with a vertical, cylindrically shaped wall 31, located in closely spaced relation to the exterior wall of the cyclone 4 so as to provide above the bottom annular wall 32 of the dam an annular water compartment 33 of narrow width. As in the case of the dam shown in FIG. 3, the dam shown in FIG. 4 is provided with a circular sill 22' over which the pollutant and water flows into the compartment. The means provided for automatically regularizing the rate of flow into the cyclone to stabilize the water level in the compartment 33 may be constituted of an extra water inlet 12 as shown in FIG. 1, or the apertures 25 shown in FIG. 3, or any suitably known level detecting means such as the means shown in FIG. 4. As shown in such figure such means may include a float 34 connected by a suitable lever arrangement 35 to a suitable control switch 36 which may be mounted on the side wall 31 of the sill and connected by suitable wiring (not shown) to the motor circuit of either of the pumps 9 or 15 to control the latter. As previously indicated, the control of the water level in the compartment 33 may be such as to create a jump 11' shown in dotted lines in FIG. 4 and to stabilize such jump at a constant level above the inlets 34, or to stabilize the water level downstream from the sill at a lower given height above the cyclone inlets as shown in full lines in FIG. 4. In the latter situation, the jump is eliminated and the hydraulic drop becomes a free overfall as shown in full lines in such figure. As previously explained, whether a hydraulic jump is formed or the hydraulic drop established at a lower level, the effect of gravity in both cases will cause a supercritical torrential flow in which the pollutant is intermittently mixed with the water flow prior to its entrance into the cyclone.

FIG. 5 shows in horizontal section an apparatus similar to that shown in FIG. 4, except that in the apparatus of FIG. 5 suitable orifices 25 are provided in the bottom wall 32 of the sill 22' for regularizing the rate of flow into the cyclone, instead of the water level control means shown in FIG. 4, and vertical plates 23' are included to ensure tangential inlet of the liquid into the cyclone in the manner of the guide vanes 23 of FIG. 3. It is to be noted that in this construction the vanes 23' do not span the space between the sill 22' and the exterior wall of the cyclone 4 but extend inwardly into the cyclone from one vertical side of the inlets 24.

The combined cyclone and dam of FIG. 5 is shown as part of a unit composed of a plurality of floats 30 which support such cyclone and dam at a given immersion level on the body of water to be cleaned. The apparatus shown in FIGS. 1–4 of the drawings are supported on the water body in a similar fashion. Preferably, the entire unit is enclosed by a protective grid 38 designed to prevent floating objects such as timber from coming into contact with the sill 22' of the submerged dam.

I claim:

1. In floating apparatus capable of removing liquid pollutant floating on the surface of a still body of water while in a stationary condition relative to the latter, a cyclone composed of a casing defining a cyclone chamber and having an enlarged end and a reduced end, the portion of said casing defining the enlarged end of the chamber having an inlet orifice for entry of a water-pollutant mixture into said chamber, a guide wall connected to said casing at said inlet orifice for directing said mixture tangentially into said chamber, a dam mounted on said cyclone casing having a water-pollutant overflow sill spaced from said casing, said dam forming with said cyclone casing a substantially closed water compartment for providing a cavity in said body of water and containing said inlet orifice, said dam in the use of the apparatus being normally submerged with its sill situated below but close to the free surface of the body of water to create with the cavity provided by said compartment a hydraulic drop with flow of water and pollutant to discharge a continuous flow of water and pollutant into said compartment to form in said compartment before the inlet orifice a level of the mixture independent of and lower than that of the free surface of the body of water being purified, the dam having a height enabling the level of the mixture in said compartment to be constantly higher than said cyclone inlet orifice whereby a continuous mixture of water and pollutant may be fed through such inlet orifice, first suction means connected to said reduced end of said cyclone casing for filling said cyclone chamber up to its ceiling with the liquid mixture from said compartment and for producing in such mixture a cyclonic rotation capable of separating the water and pollutant by centrifugation and for concentrating the pollutant in an axial central zone of the cyclone, second suction means connected to said enlarged end of said cyclone casing for removing the concentrated pollutant through the ceiling of said cyclone chamber, said first suction means removing the water freed of pollutant through said reduced end of said cyclone casing.

2. In apparatus as defined in claim 1, in which said dam is composed of two vertical side walls converging toward the inlet orifice of said cyclone and connected to the casing of said cyclone on opposite sides of such inlet orifice, and a bottom wall arranged between said side walls and connected at its inner end to the body of said cyclone below such inlet orifice, said bottom wall being connected along its sides to said side walls and forming with the latter and the portion of the cyclone body enclosed thereby said water compartment, the outer free end of said bottom wall being shaped to provide said sill.

3. In apparatus as defined in claim 1, in which said dam is composed of an upstanding wall enclosing said cyclone and a bottom wall connected to said cyclone casing and through which said cyclone extends, said dam forming with the casing of said cyclone an annularly-shaped compartment, said upstanding wall being spaced in close relation to the casing of said cyclone to form with the latter a narrow annular compartment, said cyclone being provided with a plurality of circumferentially spaced inlet openings located adjacently above said bottom wall and in communication with said annular compartment, and encircling sill portions on said upstanding wall associated with said inlet openings.

4. In apparatus as defined in claim 1, in which said dam is composed of an upstanding wall enclosing said cyclone and a bottom wall connected to said cyclone casing and through which said cyclone extends, said dam forming with the body of said cyclone an annularly-shaped compartment, said cyclone being provided with a plurality of circumferentially spaced inlet openings located adjacently above said bottom wall and in communication with said annular compartment, and encircling sill portions on said upstanding wall associated with said inlet openings, and vertical guide vanes extending between said annular wall and said cyclone casing and being tangent to the body of the cyclone at one side of said inlet openings, said vanes extending vertically from said bottom wall to a point above said inlet openings.

5. In apparatus as defined in claim 1, including means for adjusting the inlet flow of said cyclone to maintain the level of the mixture in said compartment at a given height.

6. In apparatus as defined in claim 5, in which said adjusting means includes means for detecting the level of the mixture in said compartment, said detecting means being connected to and controlling the discharge rate of one of said suction means.

* * * * *

UNITED STATES PATENT OFFICE

CERTIFICATE OF CORRECTION

PATENT NO. : 4,111,809

DATED : September 5, 1978

INVENTOR(S) : Jacques Pichon

It is certified that error appears in the above-identified patent and that said Letters Patent are hereby corrected as shown below:

The following patents should be included in the listing of U. S. Patent Documents:

| | | | |
|---|---|---|---|
| 3,830,370 | 8/1974 | Glaeser et al. | 210/242 |
| 3,780,865 | 12/1973 | Miller | 210/512 |
| 3,489,680 | 1/1970 | Snarely, Jr. | 210/512 |
| 3,743,095 | 7/1973 | Mensing et al. | 210/512 |
| 3,635,342 | 1/1972 | Mourlon et al. | 210/84 |
| 3,534,859 | 10/1970 | Amero et al. | 210/242 |
| 3,722,688 | 3/1973 | Wirsching | 210/242 |

Col. 4, line 3, "wter" should be --water--.

Col. 7, line 2, "body" should be --casing--.

Col. 7, line 6, "body" should be --casing--.

Signed and Sealed this

*Tenth* Day of *April 1979*

[SEAL]

*Attest:*

RUTH C. MASON
*Attesting Officer*

DONALD W. BANNER
*Commissioner of Patents and Trademarks*